US008161574B2

(12) United States Patent
Litt et al.

(10) Patent No.: US 8,161,574 B2
(45) Date of Patent: Apr. 24, 2012

(54) APPAREL WITH RAISED COURSE CREASE

(75) Inventors: Monica Litt, Portland, OR (US); Derek A. Costarella, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1013 days.

(21) Appl. No.: 12/122,443

(22) Filed: May 16, 2008

(65) Prior Publication Data

US 2009/0282604 A1 Nov. 19, 2009

(51) Int. Cl.

| | |
|---|---|
| ***A41B 3/04*** | (2006.01) |
| ***A41B 3/00*** | (2006.01) |
| ***D04B 1/24*** | (2006.01) |

(52) U.S. Cl. ..... 2/129; 2/116; 66/171

(58) Field of Classification Search ..... 2/129, 60, 2/98, 116, 117, 131, 132, 133, 134, 135, 2/136, 139, 140, 141.1, 141.2, 142, 143; 66/171, 170, 172 R, 173, 176

See application file for complete search history.

(56) References Cited

U.S. PATENT DOCUMENTS

| | | | | | |
|---|---|---|---|---|---|
| 189,726 | A | * | 4/1877 | Gray | 2/129 |
| 412,764 | A | * | 10/1889 | Lehman | 2/116 |
| 999,503 | A | * | 8/1911 | Klein | 2/98 |
| 1,105,407 | A | * | 7/1914 | Curtis | 66/172 R |
| 1,220,895 | A | * | 3/1917 | Sanborn | 2/98 |
| 1,414,640 | A | * | 5/1922 | Hase | 2/135 |
| 1,584,917 | A | * | 5/1926 | Easton | 139/385.5 |
| 1,613,653 | A | * | 1/1927 | Goetting | 2/129 |
| 1,668,745 | A | * | 5/1928 | Tully | 2/143 |
| 1,696,671 | A | * | 12/1928 | Duncan | 2/90 |
| 1,732,245 | A | * | 10/1929 | Slotoroff | 2/98 |
| 2,102,058 | A | * | 12/1937 | Closmann | 2/136 |
| 2,103,799 | A | * | 12/1937 | Teubner | 2/136 |
| 2,105,668 | A | * | 1/1938 | Lyons | 2/132 |
| 2,244,153 | A | * | 6/1941 | Hanisch | 66/172 R |
| 2,265,808 | A | * | 12/1941 | Jacobi | 2/116 |
| 2,289,479 | A | * | 7/1942 | Bryant | 2/131 |
| 2,344,204 | A | * | 3/1944 | Doumaux | 2/116 |
| 2,362,248 | A | * | 11/1944 | Corteen | 2/143 |
| 2,525,692 | A | * | 10/1950 | Lerner | 2/90 |
| 2,584,834 | A | * | 2/1952 | Bevins et al. | 66/176 |
| 2,639,434 | A | | 5/1953 | Liebowitz | |

(Continued)

FOREIGN PATENT DOCUMENTS

| | | |
|---|---|---|
| EP | 0037629 | 10/1981 |

(Continued)

OTHER PUBLICATIONS

International Search Report and Written Opinion for PCT/US2009/043899, mailed on Feb. 1, 2010.

*Primary Examiner* — Alissa L Hoey
(74) *Attorney, Agent, or Firm* — Plumsea Law Group, LLC

(57) ABSTRACT

An article of apparel may include a textile element that defines a crease. The textile element may be knitted to have a first course and a second course that are adjacent to each other in some areas of the textile element and spaced from each other by a raised course in other areas of the textile element. The crease extends along the third course and has a length that is substantially equal to a length of the third course. In manufacturing the textile element, the raised course may be formed between portions of the first course and the second course through a knitting process, such as a flat knitting process.

29 Claims, 18 Drawing Sheets

U.S. PATENT DOCUMENTS

| | | | | | |
|---|---|---|---|---|---|
| 2,705,582 | A | | 4/1955 | Liebowitz | |
| 2,845,688 | A | * | 8/1958 | Ainslie | 28/153 |
| 3,013,420 | A | * | 12/1961 | Cormier | 66/190 |
| 3,030,630 | A | * | 4/1962 | Kattermann | 2/116 |
| 3,031,678 | A | * | 5/1962 | Viola | 2/116 |
| 3,131,555 | A | * | 5/1964 | Rappaport | 66/171 |
| 3,237,207 | A | * | 3/1966 | Ainslie | 2/132 |
| 3,286,278 | A | * | 11/1966 | O'Connor | 2/116 |
| 3,293,662 | A | * | 12/1966 | Seiler | 2/131 |
| 3,434,309 | A | * | 3/1969 | Bellot | 66/172 R |
| 3,486,170 | A | * | 12/1969 | Rochon | 2/129 |
| 3,488,775 | A | * | 1/1970 | Dickenherr | 2/98 |
| 4,011,599 | A | | 3/1977 | Chaney | |
| 4,038,840 | A | * | 8/1977 | Castello | 66/170 |
| 4,286,337 | A | | 9/1981 | Malouf | |
| 4,375,107 | A | * | 3/1983 | Bachtiger | 2/131 |
| 4,603,440 | A | * | 8/1986 | Hale | 2/115 |
| 4,702,091 | A | * | 10/1987 | Good et al. | 66/171 |
| 4,944,041 | A | * | 7/1990 | Buenos et al. | 2/84 |
| 4,975,983 | A | | 12/1990 | Everett | |
| 5,083,319 | A | * | 1/1992 | Grilliot et al. | 2/98 |
| 5,167,037 | A | * | 12/1992 | Grilliot et al. | 2/98 |
| 5,274,853 | A | | 1/1994 | Millican | |
| 5,400,438 | A | * | 3/1995 | Staff et al. | 2/129 |
| 6,032,295 | A | * | 3/2000 | Marshall | 2/239 |
| 6,089,422 | A | | 7/2000 | Gibson | |
| 6,167,732 | B1 | * | 1/2001 | Friedman | 66/173 |
| 6,389,850 | B1 | * | 5/2002 | Fujiwara | 66/176 |
| 6,477,713 | B2 | * | 11/2002 | Krause et al. | 2/129 |
| 6,490,735 | B2 | * | 12/2002 | Rindle | 2/98 |
| 6,611,960 | B2 | * | 9/2003 | Kim | 2/129 |
| 6,708,344 | B2 | | 3/2004 | Friedman | |
| RE39,095 | E | * | 5/2006 | Friedman | 66/173 |
| 7,841,214 | B2 | * | 11/2010 | Park | 66/172 E |
| 7,849,520 | B2 | * | 12/2010 | Blenkarn | 2/129 |
| 2002/0062513 | A1 | * | 5/2002 | Kim | 2/129 |
| 2002/0120974 | A1 | * | 9/2002 | Krause et al. | 2/129 |
| 2007/0214542 | A1 | * | 9/2007 | Kim | 2/129 |
| 2008/0190148 | A1 | * | 8/2008 | Park | 66/172 R |

FOREIGN PATENT DOCUMENTS

| | | |
|---|---|---|
| FR | 635505 | 3/1928 |

* cited by examiner

APPAREL WITH RAISED COURSE CREASE

BACKGROUND

Many articles of apparel incorporate creases that enhance the appearance or functionality of the apparel. Shirt collars, for example, incorporate creases that impart an ironed or freshly-laundered appearance. Many pairs of pants, for example, incorporate creases that expand and contract to provide extra room and a freedom of movement for the wearer.

SUMMARY

An article of apparel is disclosed below as including a textile element that defines a crease. In some configurations, the textile element has a first course and a second course that extend toward a pair of opposite edges of the textile element. The first course and the second course are adjacent to each other in areas of the textile element that are proximal to the opposite edges. The textile element also includes a third course that is positioned between the first course and the second course. The crease extends along the third course and has a length that is substantially equal to a length of the third course.

A method of manufacturing a textile element with a crease is also disclosed below. In some configurations, the method includes forming a first course that extends between opposite edges of the textile element. A raised course that is adjacent to the first course and spaced inward from the opposite edges is also formed. In addition, a second course that extend between the opposite edges of the textile element is formed. End areas of the second course are adjacent to the first course, and a central area of the second course is spaced from the first course by the raised course.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various articles of apparel with creased textile elements.

Apparel Configuration

Figure 1:
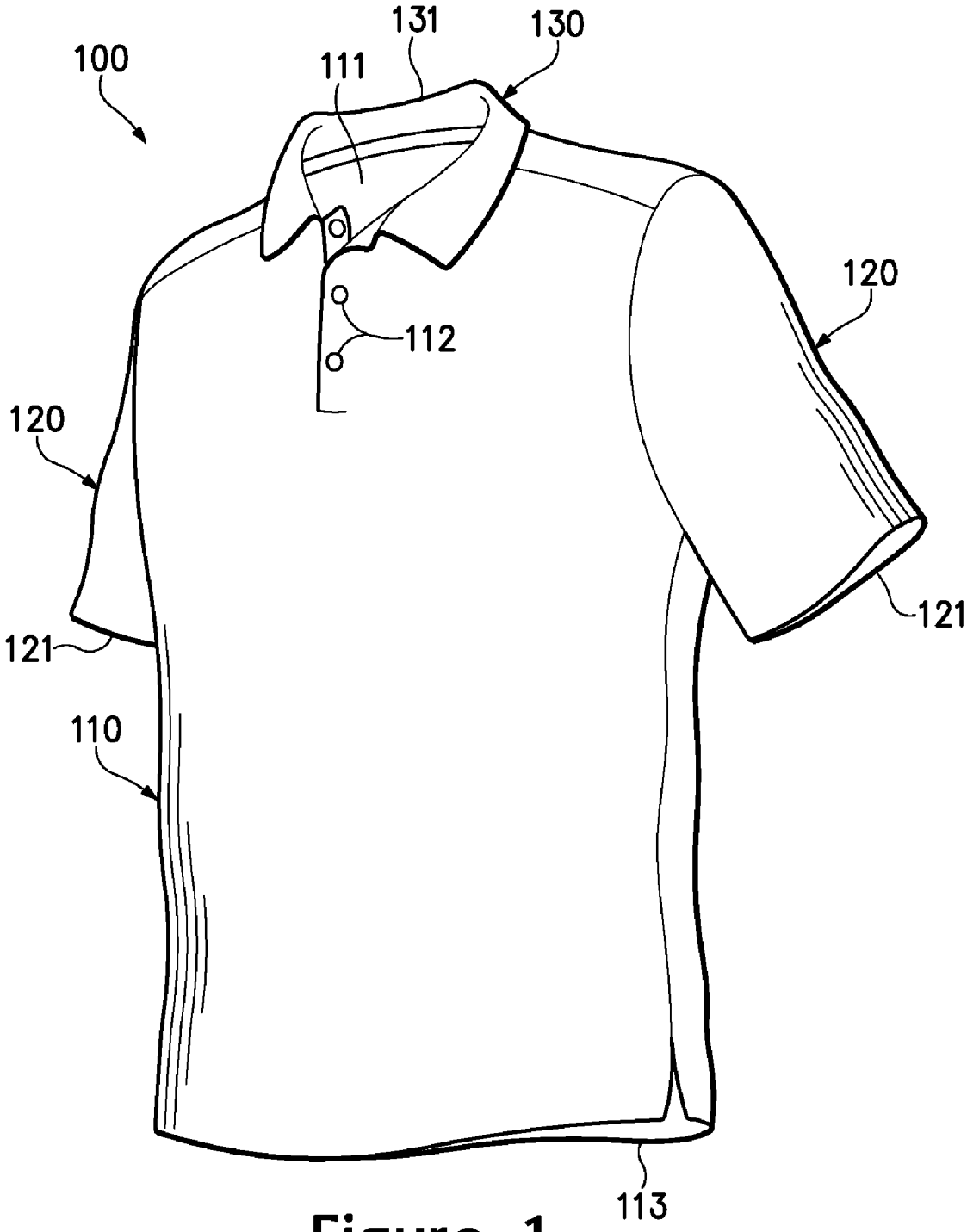
FIG. 1 is a perspective view of an article of apparel.
Figure 2:
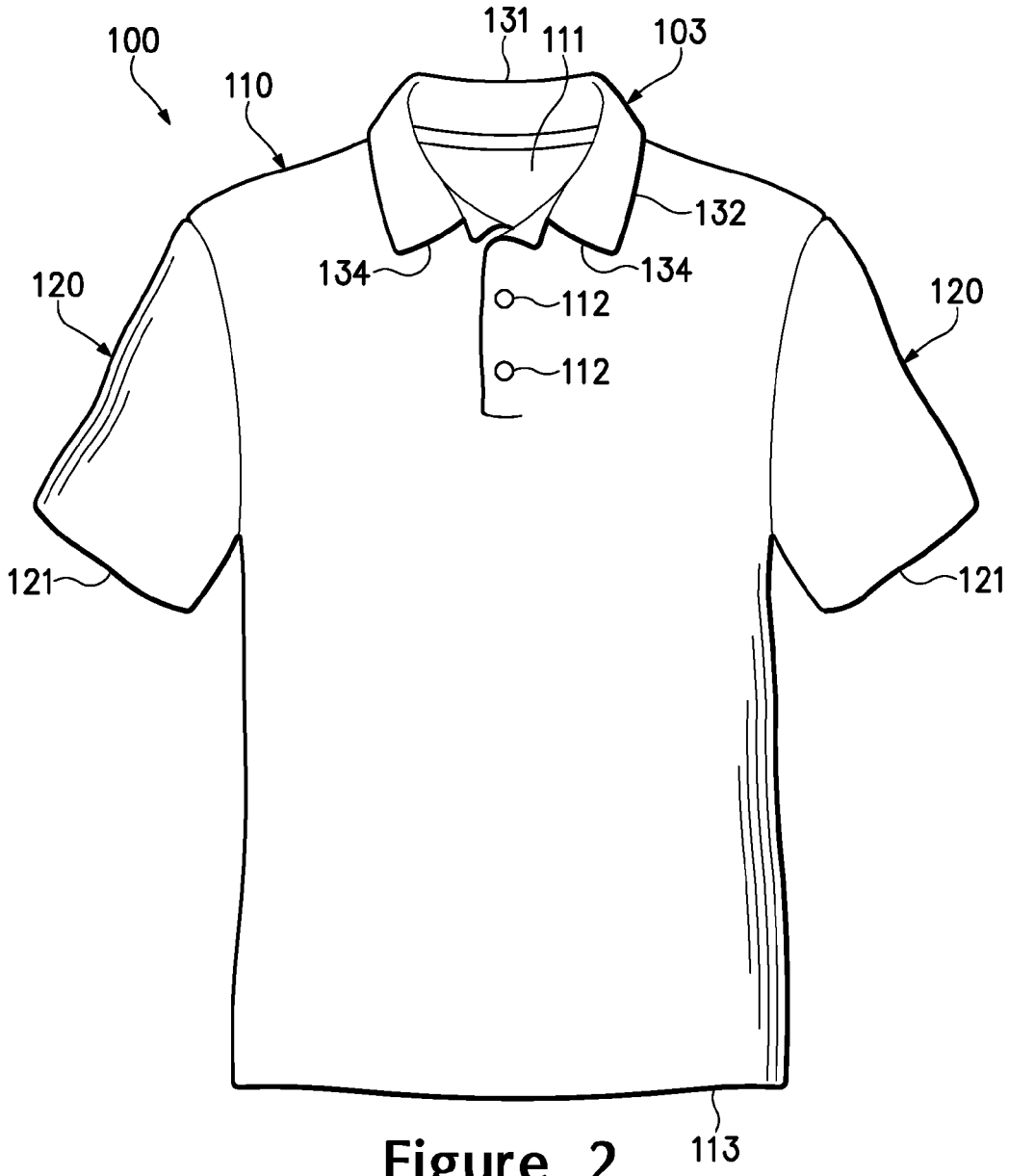
FIG. 2 is a front elevational view of the article of apparel.
Figure 3:
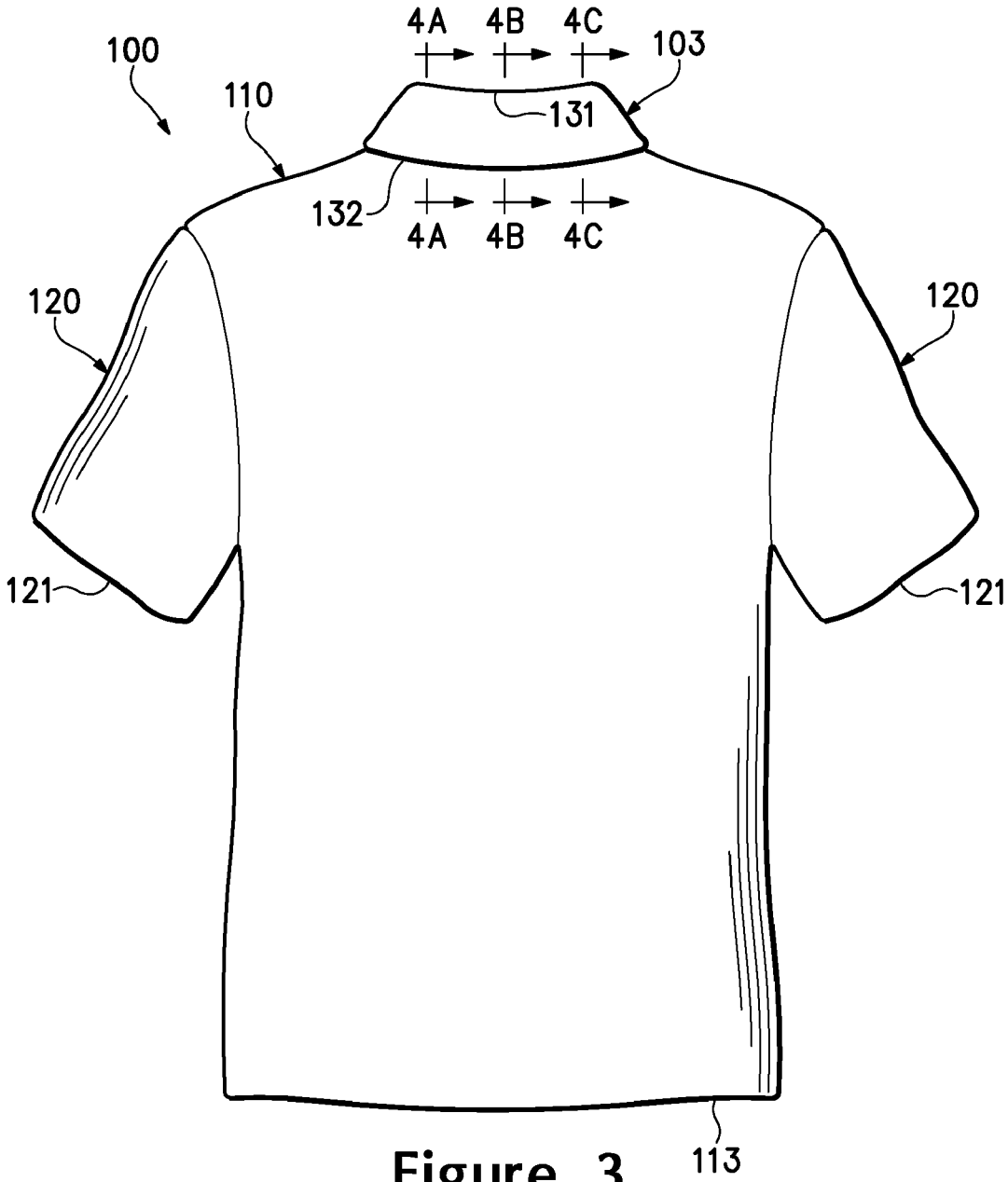
FIG. 3 is a rear elevational view of the article of apparel.

An article of apparel 100 is depicted in FIGS. 1-3 as having a torso region 110 and a pair of arm regions 120. Torso region 110 corresponds with a torso of a wearer and covers at least a portion of the torso when worn. An upper area of torso region 110 defines a neck opening 111 through which the neck and head of the wearer protrude when apparel 100 is worn. A size of neck opening 111 may be adjusted through use of a conventional button system 112. Similarly, a lower area of torso region 110 defines a waist opening 113 through which the waist or pelvic area of the wearer protrudes when apparel 100 is worn. Arm regions 120 correspond with arms of the wearer and cover at least a portion of the arms when apparel 100 is worn. Each of arm regions 120 define an arm opening 121 through which the arms protrude when apparel 110 is worn.

Apparel 100 also includes a collar 130 that is secured to torso region 110 adjacent to neck opening 111. Collar 130 is formed from a textile element that extends in an upward direction from neck opening 111 (i.e., the area where collar 130 is secured to torso region 110 adjacent to neck opening 111) and then folds over to extend in a downward direction. In order to facilitate the folding of collar 130 in a specific location and also provide other aesthetic benefits, collar 130 defines a crease 131 in a rear area of apparel 100. As discussed in greater detail below, a knitting process that is utilized to manufacture a textile element forming collar 130 includes the formation of crease 131 through the addition of a raised course within the textile element. As discussed in greater detail below, crease 131 is not a significantly thickened area of collar 130, but is formed through the addition of a knitted course that imparts an angular or disjointed aspect to collar 130, thereby defining crease 131.

Figures 4A, 4B, 4C:
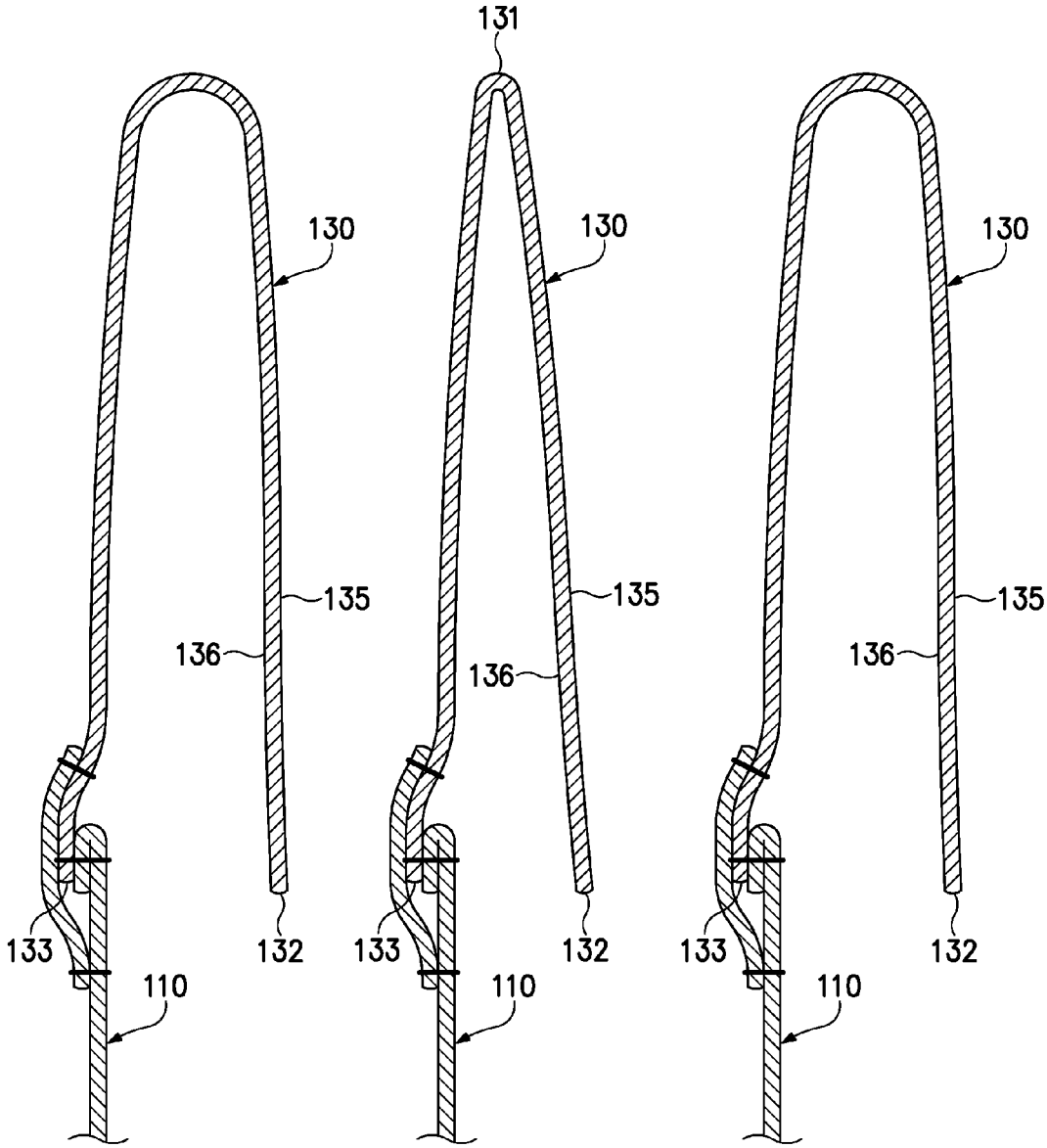
FIGS. 4A-4C are cross-sectional views of a collar of the article of apparel, as defined by section lines 4A-4C in FIG. 3.

Crease 131 is centrally-positioned in the rear area of apparel 100 and extends across only a portion of a width of collar 130. When apparel 100 is worn, crease 131 is located behind the neck of the wearer and may extend outward from sides of the neck. In general, however, crease 131 has a length that remains behind the neck. Referring to FIGS. 4A-4C, various cross-sections through collar 130 and upper areas of torso region 110 are depicted. Whereas crease 131 is absent in the cross-sections of FIGS. 4A and 4C, crease 131 is present in the cross-section of FIG. 4B. In comparing these cross-sections, areas where crease 131 are absent have a generally rounded or less-distinct fold in collar 130, whereas crease 131 imparts a generally pointed or otherwise distinct ridge in the fold of collar 130.

Figure 5:
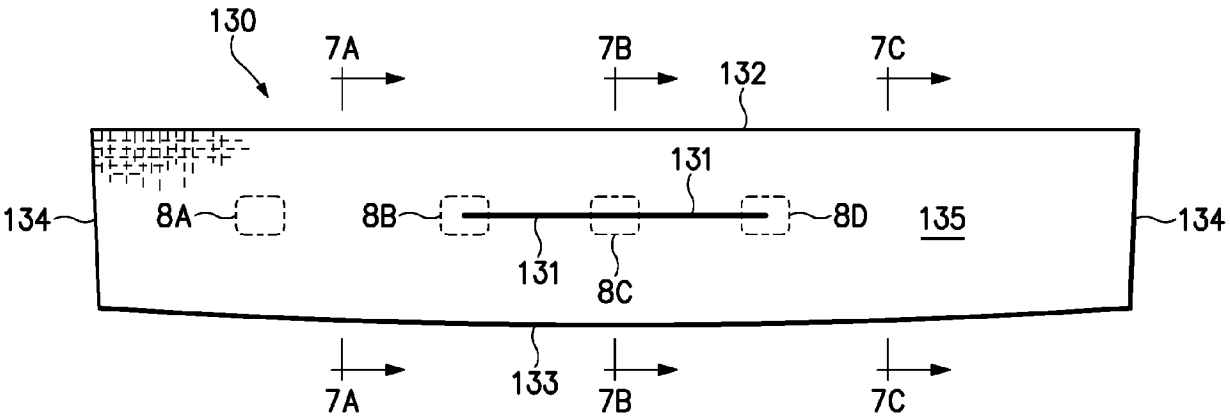
FIG. 5 is a top plan view of a textile element that forms the collar.
Figure 6:
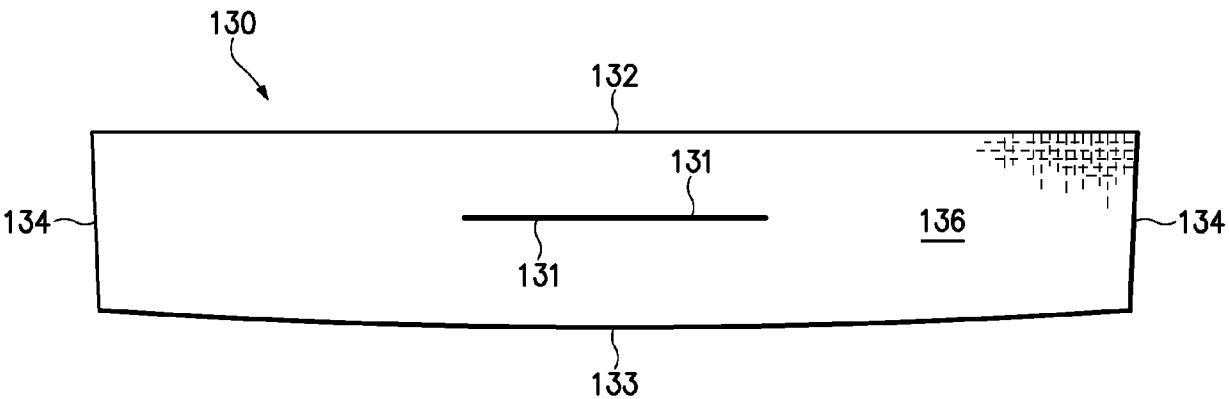
FIG. 6 is a bottom plan view of the textile element.

A textile element that forms collar 130 is depicted separate from apparel 100 in FIGS. 5 and 6. Collar 130 has a generally rectangular configuration that includes a free edge 132, an attachment edge 133, and a pair of side edges 134. Although edges 132-134 are depicted as being generally linear, any of edges 132-134 may be somewhat rounded or otherwise non-linear. When incorporated into apparel 100, free edge 132 forms an unsecured end area of collar 130, whereas attachment edge 133 is secured to torso region 110 adjacent to neck opening 111. Side edges 134 extend between end areas of each of edges 132 and 133 to form side portions of collar 130. Although a position and length of crease 131 may vary significantly, as described in greater detail below, crease 131 is generally spaced from each of edges 132-134 and positioned in a central area of collar 130. Moreover, crease 131 may also be substantially parallel to each of edges 132 and 133 and substantially perpendicular to side edges 134. Depending upon the specific shape of collar 130, however, the position of crease 131 and the geometrical relationships between crease 131 and edges 132-134 may vary significantly.

Figure 7A:
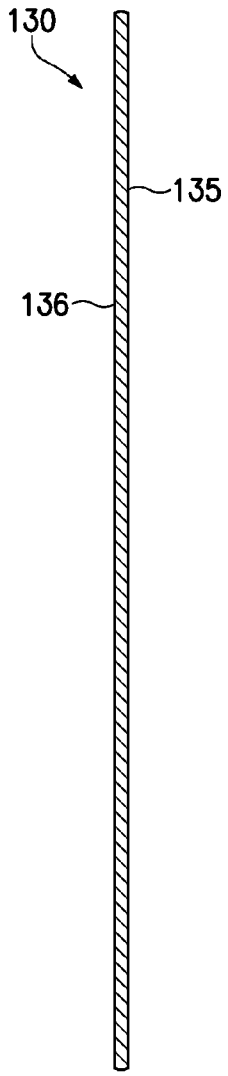
FIGS. 7A-7C are cross-sectional views of the textile element, as defined by section lines 7A-7C in FIG. 5.
Figure 7B:
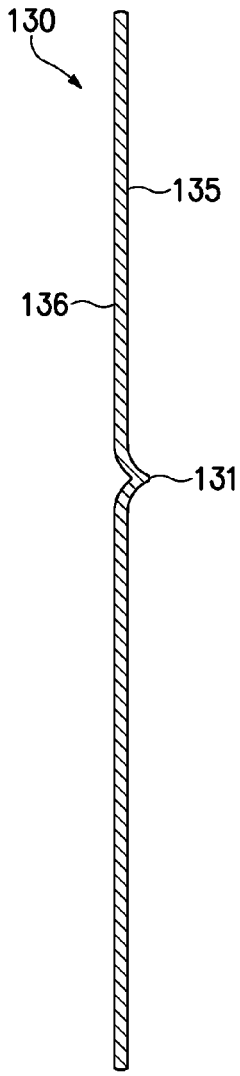
Figure 7C:
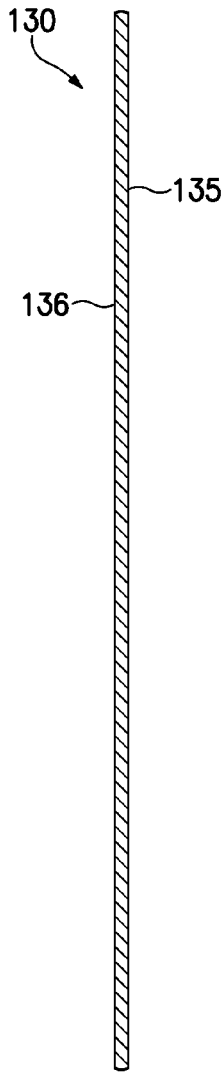

Collar 130 has an outward-facing surface 135 and an opposite inward-facing surface 136. Whereas outward-facing surface 135 generally forms an outward-facing portion of collar 130 that is visible from the exterior of apparel 100, inward-facing surface 136 generally forms an inward-facing portion of collar 130 that is mostly hidden from the exterior of apparel 100. A majority of surfaces 135 and 136 are generally planar. In the region of crease 131, however, outward-facing surface 135 forms a protruding area and inward-facing surface 136 forms an indented area. Referring to FIGS. 7A-7C, various cross-sections through the textile element that forms collar 130 are depicted. In comparing these cross-sections, areas where crease 131 are absent have a generally planar configuration in collar 130, whereas crease 131 respectively imparts a protruding area and an indented area in surfaces 135 and 136. Accordingly, crease 131 is not a significantly thickened area of collar 130, but is an angular or otherwise disjointed area within collar 130.

Crease 131 facilitates the folding of collar 130 in a specific location. When apparel 100 is worn, crease 131 ensures that collar 130 folds at the location of crease 131. If collar 130 were folded in a location that is adjacent to neck opening 111, then collar 130 may lay adjacent to the back of the wearer and exhibit a flat appearance. Conversely, if collar 130 were folded in a location that is adjacent to free edge 132, then collar 130 may stand overly upright. By placing crease 131 in a particular location relative to edges 132 and 133, the location at which collar 130 folds may be influenced.

Although a width of collar 131 may vary significantly, a distance between free edge 132 and attachment edge 134 through a center of collar 130 may be approximately 8.26 centimeters (3.25 inches), and the distance between free edge 132 and attachment edge 134 along side edges 134 may be approximately 7.62 centimeters (3.00 inches) In this configuration, approximately 0.64 centimeter (0.25 inches) may be allocated for a seam allowance, which is the portion of collar 130 utilized to join collar 130 to torso region 110. That is, approximately 7.62 centimeters (3.00 inches) of collar 130 may extend outward from torso region 110. Given these dimensions, crease 131 may be spaced approximately 4.64 centimeters (1.875 inches) from free edge 132. More generally, crease 131 may be positioned at approximately 58 percent of a distance between free edge 132 and attachment edge 133. Although this position is suitable for crease 131, the position of crease 131 may vary significantly depending upon the style of apparel 100, the specific structure of apparel 100, or the aesthetic intended to be imparted by apparel 100. In other configurations of apparel 100, therefore, crease 131 may be located anywhere in a range of one-sixth to five-sixths of a distance from free edge 132 to attachment edge 133. More particularly, crease 131 may be located between (a) one-third and two-thirds of a distance from free edge 132 to attachment edge 133, (b) one-half and six-tenths of a distance from free edge 132 to attachment edge 133, or (c) one-half and seven-tenths of a distance from free edge 132 to attachment edge 133, for example. Accordingly, the specific position of crease 131 relative to edges 132 and 133 may vary significantly.

A length of length of collar 131 (i.e., a distance between side edges 134) may also vary significantly and may at least partially depend upon the size of apparel 100. For configurations of apparel 100 intended to be worn by men, the length of collar 131 may vary as follows: (a) for a size of extra-small or small, a distance between side edges 134 may be approximately 40.6 centimeters (16.0 inches), (b) for a size of medium or large, a distance between side edges 134 may be approximately 43.2 centimeters (17.0 inches), (c) for a size of extra-large or 2-extra-large, a distance between side edges 134 may be approximately 45.7 centimeters (18.0 inches), (d) for a size of 3-extra-large or 4-extra-large, a distance between side edges 134 may be approximately 48.3 centimeters (19.0 inches), and (e) for a size of 5-extra-large, a distance between side edges 134 may be approximately 50.8 centimeters (20.0 inches). For each of these sizes, crease 131 may have a length of approximately 11.4 centimeters (4.50 inches). Moreover, the length of crease 131 may be less than one-third of the distance between side edges 134, but may also be less than one-fourth of the distance between side edges 134. Although this relative length is suitable for crease 131, the length of crease 131 may vary significantly depending upon the style of apparel 100, the specific structure of apparel 100, or the aesthetic intended to be imparted by apparel 100. In other configurations of apparel 100, therefore, crease 131 may have a length anywhere in a range of the entire distance between side edges 134 to one-twentieth of the distance between side edges 134. Accordingly, the specific position of crease 131 relative to side edges 134 may vary significantly.

In addition to facilitating the folding of collar 130 in a specific location, crease 131 may also provide additional aesthetic benefits. In some articles of apparel, creases may be formed through ironing or other non-permanent methods. Following prolonged wear and exposure to moisture (e.g., precipitation, humidity, perspiration), an ironed crease may diminish. By utilizing a knitting process to form crease 131 as a part of the structure of collar 130, crease 131 may remain within collar 130 following prolonged wear and exposure to moisture, thereby enhancing the aesthetic properties of apparel 100.

Manufacturing Process

Collar 130 may, for example, be formed through a flat knitting process. In general, flat knitting is a method for producing knitted textile elements in which the textile is turned periodically (i.e., the textile is knitted from alternating sides). The two sides of the textile (otherwise referred to as faces) are conventionally designated as the right side (i.e., the side that faces outwards, towards the viewer) and the wrong side (i.e., the side that faces inwards, away from the viewer). Although flat knitting provides a suitable manner for forming collar 130, other types of knitting processes may also be utilized, including wide tube circular knitting, narrow tube circular knit jacquard, single knit circular knit jacquard, double knit circular knit jacquard, and warp knit jacquard, for example.

An advantage of flat knitting over the various other types of knitting is that the flat knitting process may be utilized to form generally three-dimensional structures, as in the area of crease 131. In contrast with the "flat" terminology in "flat knitting", therefore, non-planar, curved, or otherwise generally three-dimensional structures may be produced through flat-knitting. In addition, flat knitting may be utilized to form areas with different types of stitches and areas with different types or colors of yarns. For example, areas of collar 130 may have a ribbed configuration, whereas other areas may have a non-ribbed configuration. Moreover, areas of collar 130 may be formed from stretch yarns, whereas other areas may be formed from non-stretch yarns. Accordingly, the flat knitting process may be utilized to form a generally three-dimensional structure having areas with different properties that are produced from combinations of different types of stitches and different types or colors of yarns.

Another advantage of the flat knitting process relates to the overall shape of collar 130 and the configuration of edges 132-134. More particularly, collar 130 may be knitted to have the shape depicted in FIGS. 5 and 6 without subsequent significant cutting operations because the flat knitting process imparts a generally finished configuration to edges 132-134. That is, collar 130 may be formed with a defined shape that does not need to be cut from a larger textile element. Unlike textile elements cut from a larger textile element, therefore, edges 132-134 do not need to be finished to prevent unraveling and enhance their aesthetic properties.

The general procedure for knitting collar 130 involves forming a plurality of rows and columns of intermeshed loops, which are conventionally referred to as courses and wales. The courses within collar 130 are rows of needle loops produced by adjacent needles during the knitting cycle, whereas the wales are columns of intermeshed needle loops generally produced by the same needle on successive knitting cycles.

Figure 8A:
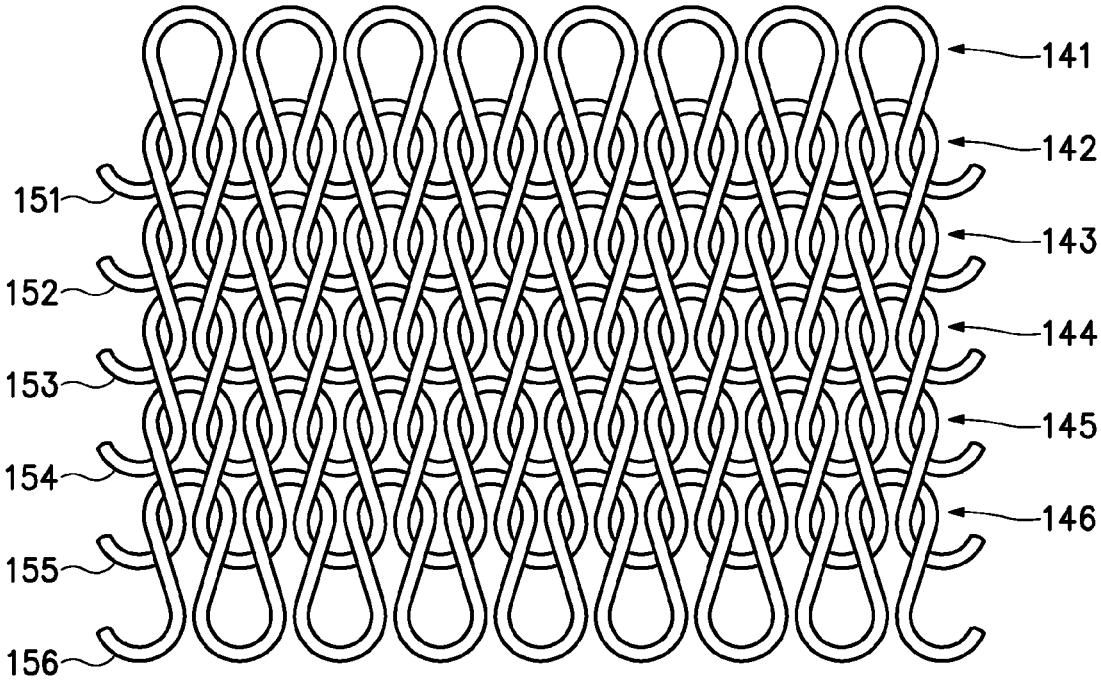
FIGS. 8A-8D are schematic top plan views of a knit structure of the textile element, as defined by areas 8A-8D in FIG. 5.
Figure 8B:
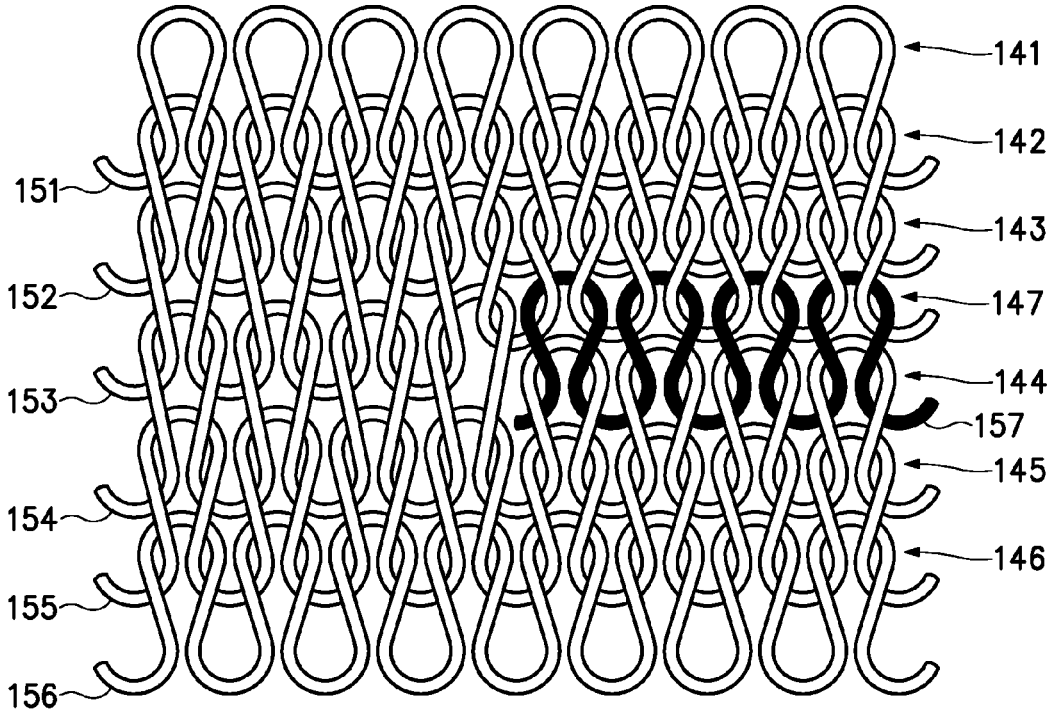
Figure 8C:
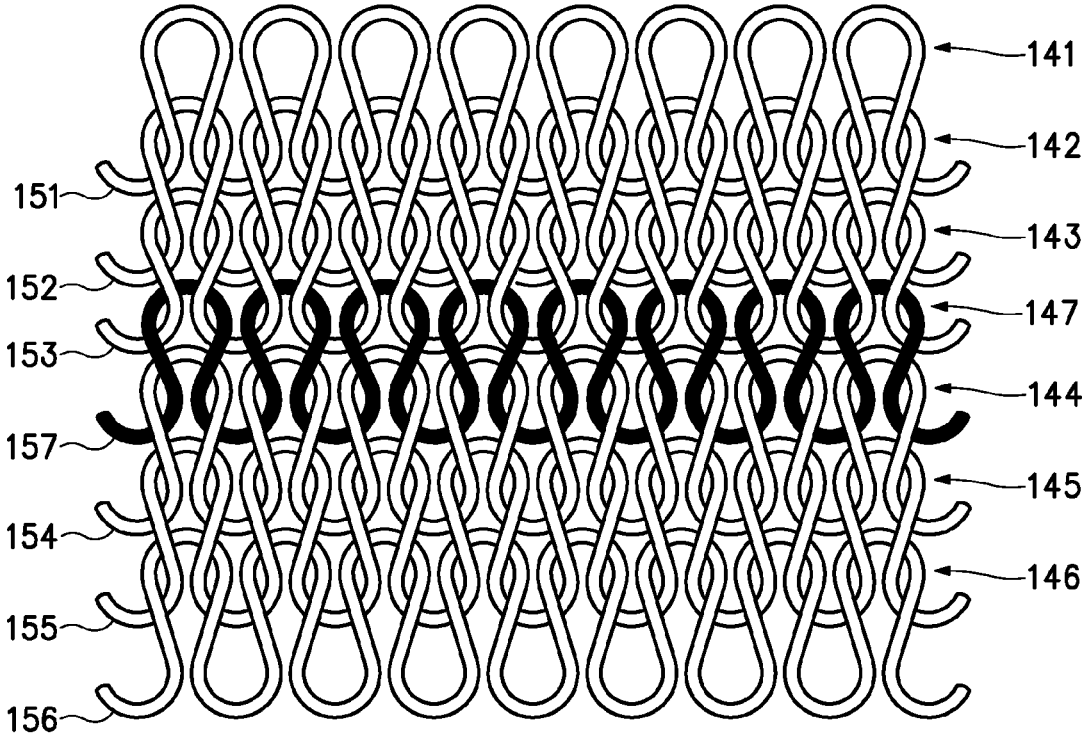
Figure 8D:
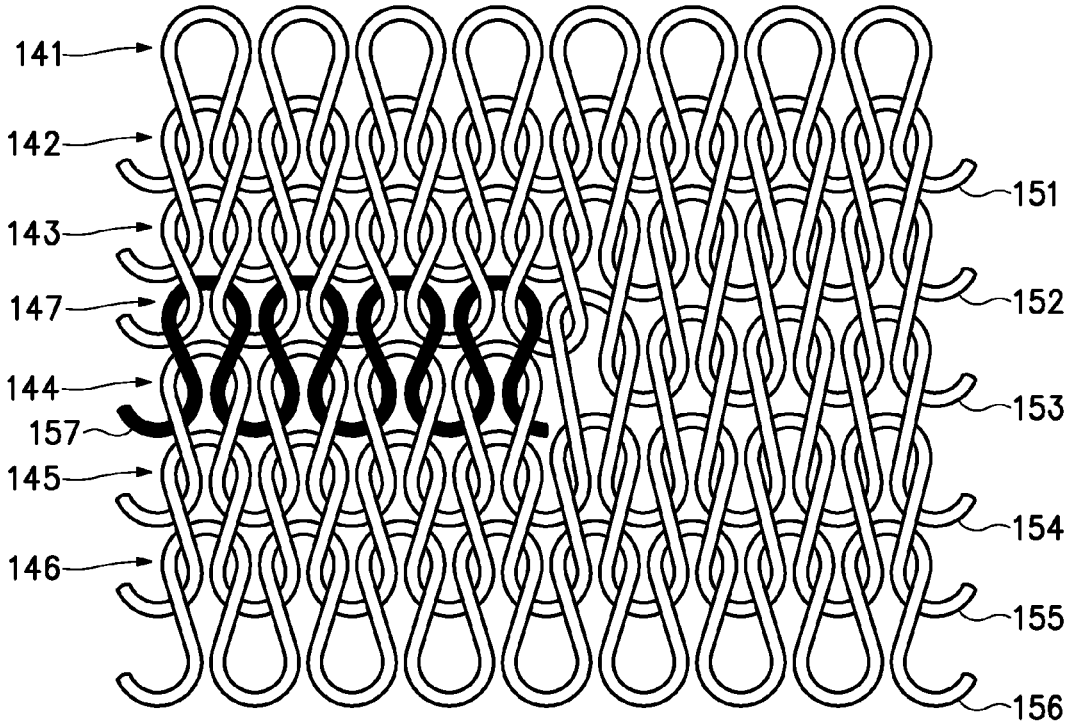

The knit structure of collar 130 is generally too small or fine to be clearly viewed in FIGS. 5 and 6. In order to show the knit structure in more detail, various areas 8A-8C are defined in FIG. 5 and schematically-depicted in FIGS. 8A-8D. In general, FIG. 8A depicts an area of collar 130 that is separate from crease 131, FIG. 8B depicts an area of collar 130 that corresponds with an end portion of crease 131, FIG. 8C depicts an area of collar 130 that corresponds with an central portion of crease 131, and FIG. 8D depicts an area of collar 130 that corresponds with an opposite end portion of crease 131. In each of FIGS. 8A-8D, six courses 141-146 (i.e., horizontal rows) are depicted and the yarns forming each of the six courses are identified as yarns 151-156. In FIGS. 8B-8D, a raised course 147 that forms crease 131 is depicted and the yarn forming the raised course is identified as yarn 157. Although not referenced, the various yarns 151-157 form various wales (i.e., vertical columns) in the areas of collar 130 depicted in FIGS. 8A-8D.

Referring to FIG. 8A, an area of collar 130 that is separate from crease 131 and spaced from crease 131 (e.g., between the end portion of crease 131 and one of side edges 134) is depicted. In this area, courses 141-146 are substantially parallel to each other. Although not depicted, courses 141-146 may have a length that is sufficient to extend between side edges 134. That is, courses 141-146 may extend through the entire length of collar 130. In some configurations of collar 130, courses 141-146 may extend only partially between side edges 134.

Referring to FIG. 8B, the area of collar 130 corresponding with the end portion of crease 131 is depicted. In this area, raised course 147 initiates between courses 143 and 144. In other words, courses 143 and 144 effectively separate and become non-parallel to permit the introduction of yarn 157, which forms raised course 147 and effectively forms crease 131. Whereas yarns 153 and 154 form intermeshed loops with each other in FIG. 8A, yarns 153 and 154 begin forming intermeshed loops with yarn 157 in FIG. 8B. As discussed above, crease 131 is not a significantly thickened area of collar 130, but is formed through the addition of raised course 147 to impart an angular or disjointed aspect to collar 130.

Referring to FIG. 8C, the area of collar 130 that corresponds with the central portion of crease 131 is depicted. In this area, courses 141-147 are substantially parallel to each other and raised course 147 (yarn 157) is positioned between courses 143 and 144 (yarns 153 and 154). As noted above, raised course 147 effectively forms crease 131. Whereas courses 143 and 144 were adjacent to each other in the area of FIG. 8A, courses 143 and 144 are separated by raised course 147 in the area of FIG. 8C. In effect, therefore, three courses (i.e., courses 143, 144, and 147) are located in an area having sufficient space for two courses (i.e., 143 and 144). By placing an additional course (i.e., raised course 147) within this area, collar 130 forms a protruding area on outward-facing surface 135 and forms an indented area on inward-facing surface 136, thereby forming crease 131. Accordingly, the introduction of raised course 147 effectively forms crease 131.

As discussed above, an advantage of flat knitting over various other types of knitting is that the flat knitting process may be utilized to form generally three-dimensional structures, as in the area of crease 131. Utilizing flat knitting techniques, therefore, the knit structure of collar 130 may be configured to form raised course 147 and define crease 131. That is, flat knitting techniques may be utilized to form a generally three-dimensional structure (i.e., crease 131) within collar 130. In general, therefore, crease 131 extends along raised course 147 and will have a length that is substantially equal to the length of raised course 147.

In order to enhance the three-dimensional aspect of crease 131 in raised course 147, yarn 157 may have different properties than yarns 151-156. For example, yarn 157 may exhibit greater thickness, greater stiffness, or a combination of greater thickness and stiffness than yarns 151-156. By selecting yarn 157 to have different properties than yarns 151-156, the degree to which crease 131 forms a protruding area on outward-facing surface 135 and forms an indented area on inward-facing surface 136 may be increased.

Referring to FIG. 8D, the area of collar 130 corresponding with the opposite end portion of crease 131 is depicted. In this area, raised course 147 terminates between courses 143 and 144. In other words, courses 143 and 144 effectively come back together and become parallel to permit the removal of yarn 157. Whereas yarns 153 and 154 form intermeshed loops with yarn 157 in FIG. 8C, yarns 153 and 154 begin forming intermeshed loops with each other in FIG. 8D.

A variety of procedures for forming collar 130 with crease 131 may be utilized. In general, however, various courses (e.g., courses 141-143) are formed between side edges 134. Raised course 147 is then formed adjacent to course 143. Whereas courses 141-143 extend between side edges 134, raised course 147 is spaced inward from side edges 134. Various additional courses (e.g., courses 144-146) are formed between side edges 134. In this procedure, the end areas of courses 143 and 144 are adjacent to each other and form intermeshed loops with each other, but the central areas of courses 143 and 144 are spaced from each other by raised course 147 and form intermeshed loops with raised course 147.

An example of a suitable flat knitting machine that may be utilized in manufacturing collar 130 is a KH-212 Computerized Full Jacquard Flat Knitting machine, as manufactured by Kauo Heng Precision Machinery Industrial Company, Ltd. of Taiwan. In preparing this flat knitting machine for the manufacture of collar 130, the number of needles that fit to the length of collar 130 are determined and set. A program relating to the manufacture of collar 130 is then copied to the flat knitting machine. In an example where polyester and elastane yarns are utilized in collar 130, eight bobbins of the polyester yarn and one bobbin of the elastane yarn are then prepared and placed within feeders. More particularly, two of the polyester yarns may be placed within a first feeder, three of the polyester yarns may be placed within a second feeder, three of the polyester yarns may be placed within a third feeder, and the one elastane yarn may be placed within the fourth feeder. Once the flat knitting machine is prepared, yarn carriers may move back and forth to make loops on the various sides of collar 130 to form the knit structure. Moreover, the flat knitting machine may, as programmed, define crease 131 by forming raised course 147 between courses 143 and 144, as discussed above.

In the example discussed above, a majority of collar 130 is formed from polyester. In order to provide stretch and recovery, elastane fibers may also be utilized, which are available from E.I. duPont de Nemours Company under the LYCRA trademark. In addition to or as a substitution for the polyester and elastane yarns, the yarns forming collar 130 (e.g., yarns 151-157) may include cotton and wool fibers, natural filaments such as silk, and synthetic filaments that include rayon, nylon, and acrylic, for example. The characteristics of the yarns selected for collar 130 depend primarily upon the materials that form the various filaments and fibers of the yarns. Cotton, for example, provides a soft hand, natural aesthetics, and biodegradability. Elastane provides stretch and recovery. Rayon provides high luster and moisture absorption. Wool also provides high moisture absorption, in addition to insulating properties. Polytetrafluoroethylene coatings may provide a low friction contact between collar 130 and the skin. Nylon is a durable and abrasion-resistant material with high strength, and polyester is a hydrophobic material that also provides relatively high durability. Accordingly, the materials comprising the yarns may be selected to impart a variety of physical properties to collar 130.

Further Collar and Apparel Configurations

Figure 9A:
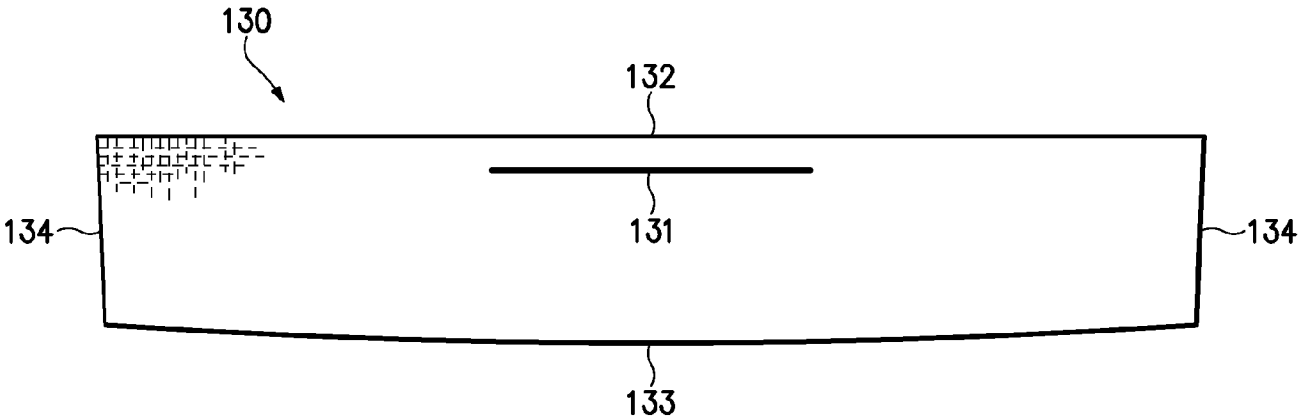
FIGS. 9A-9N are top plan views corresponding with FIG. 5 and depicting further configurations of the textile element.
Figure 9B:
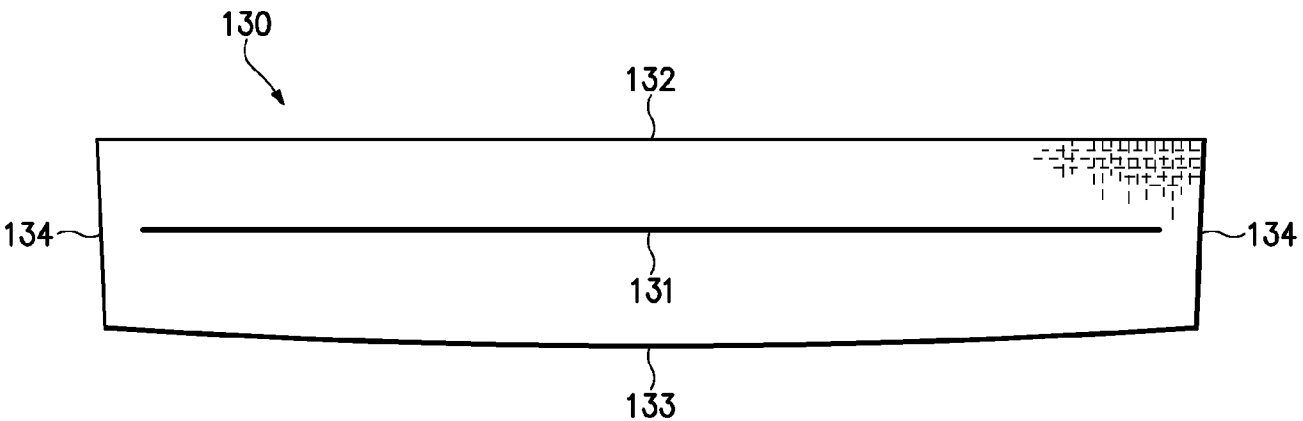
Figure 9C:
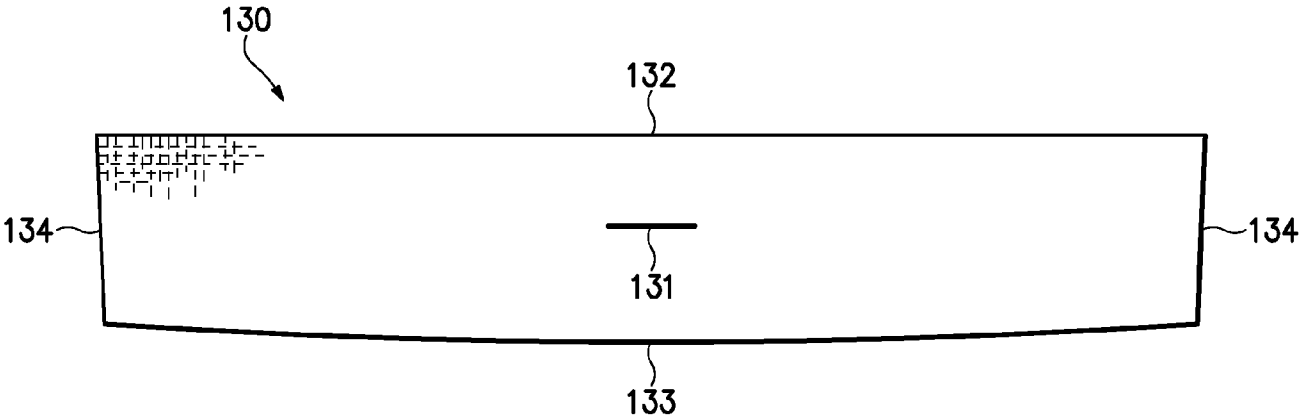
Figure 9D:
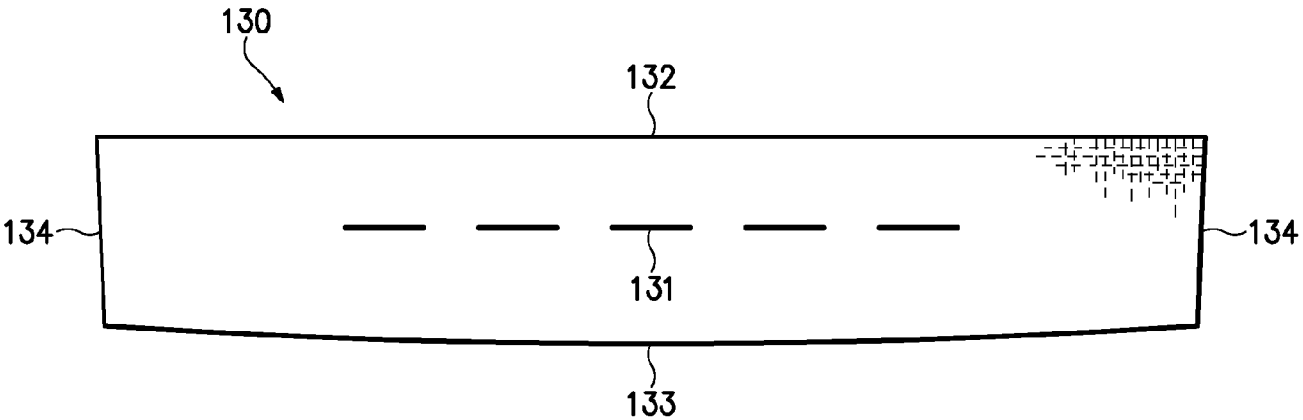
Figure 9E:
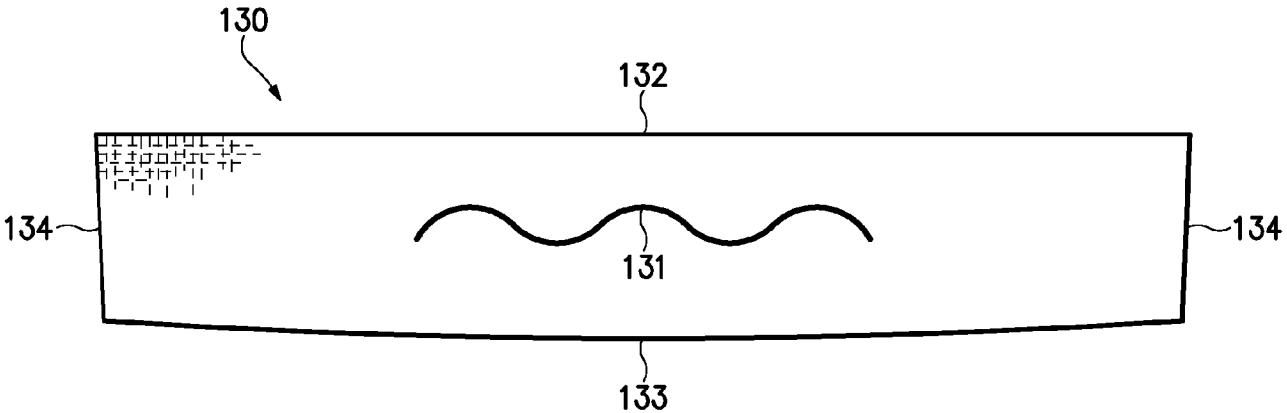
Figure 9F:
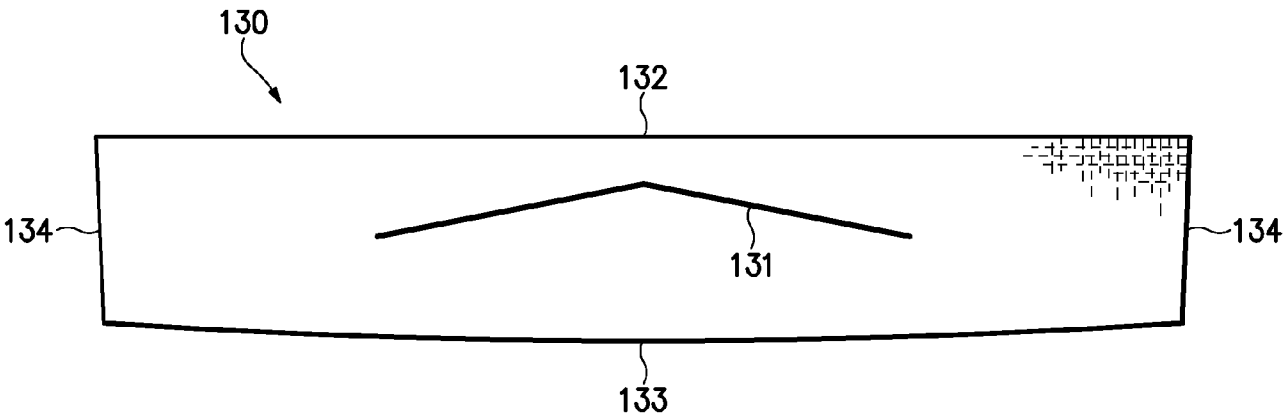
Figure 9G:
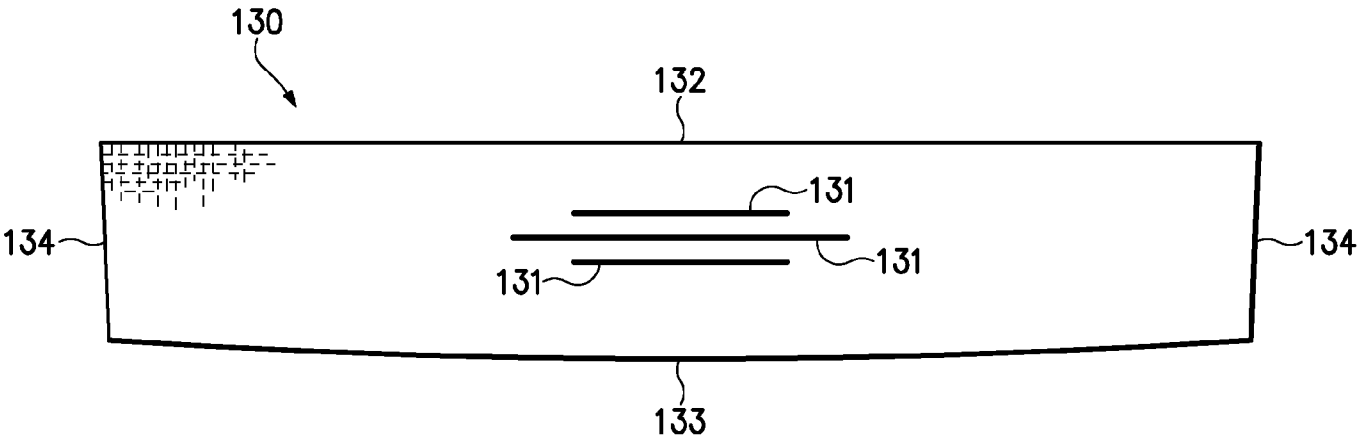
Figure 9H:
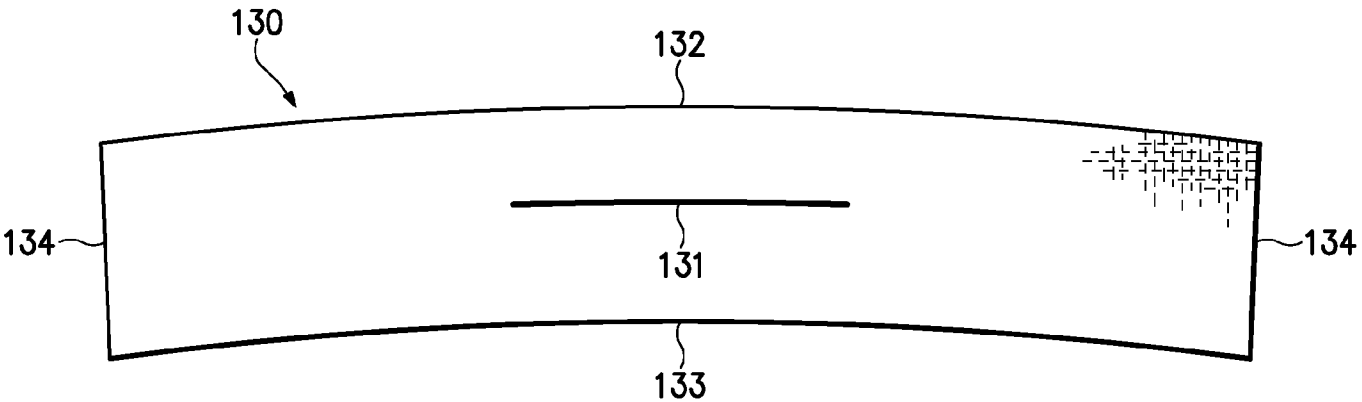
Figure 9I:
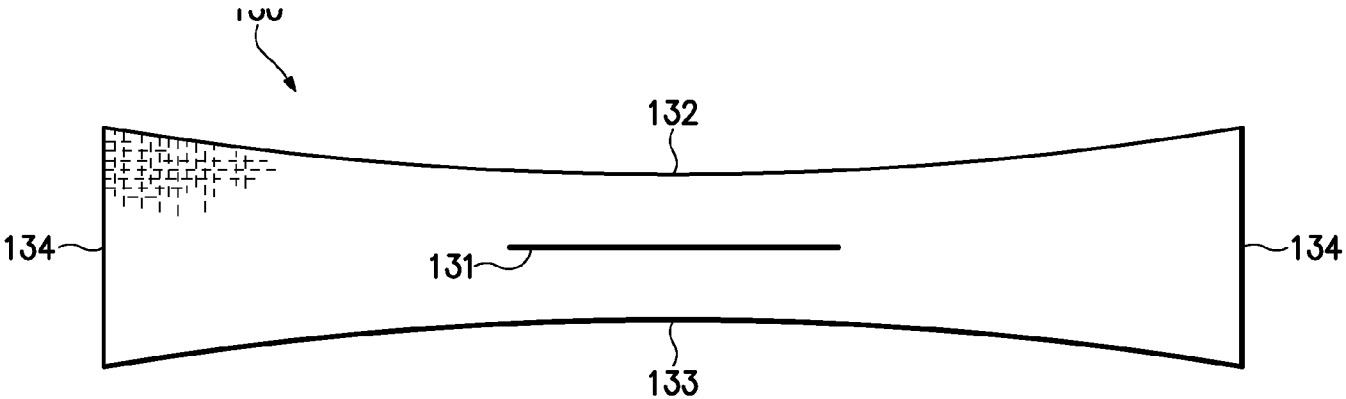
Figure 9J:
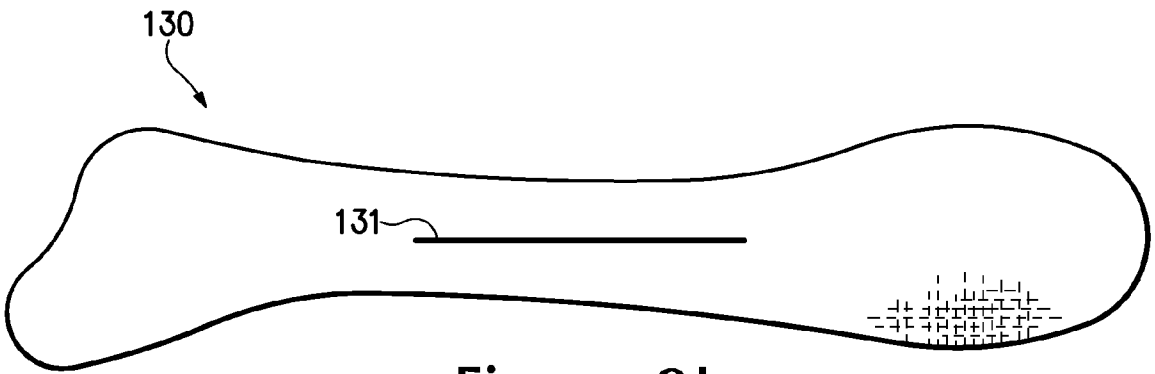
Figure 9K:
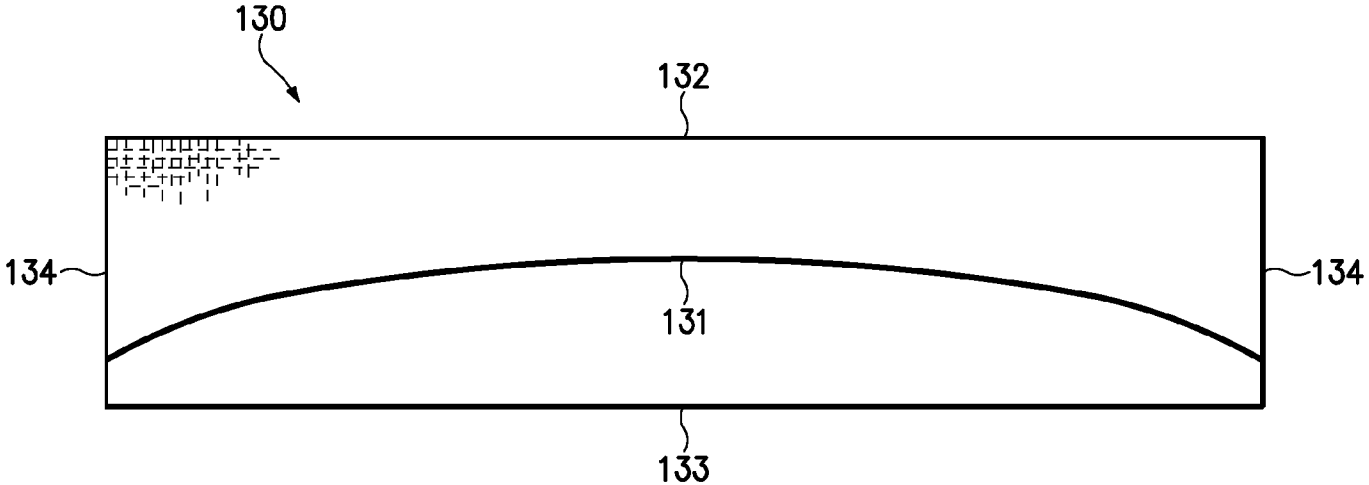
Figure 9L:
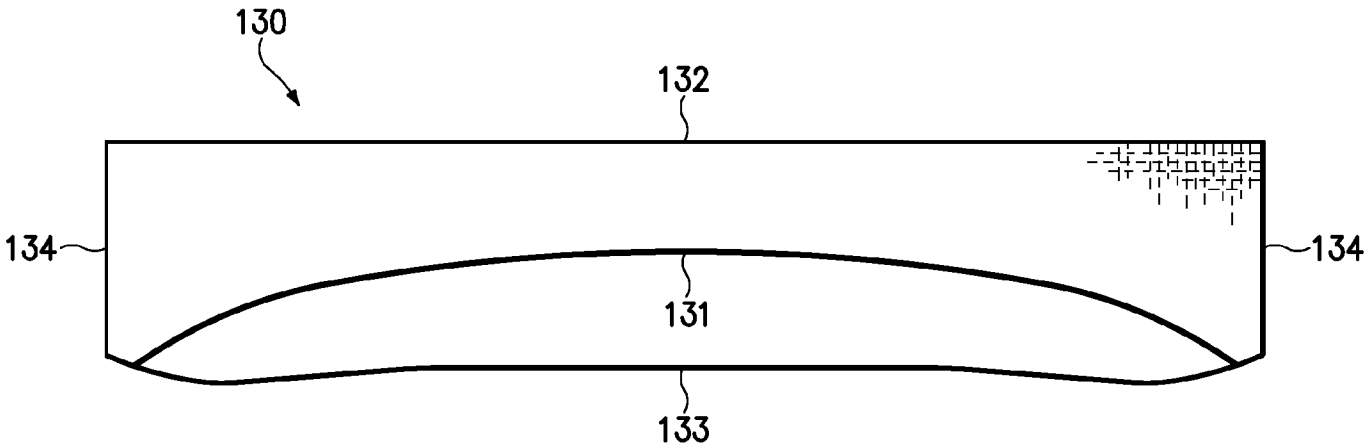
Figure 9M:
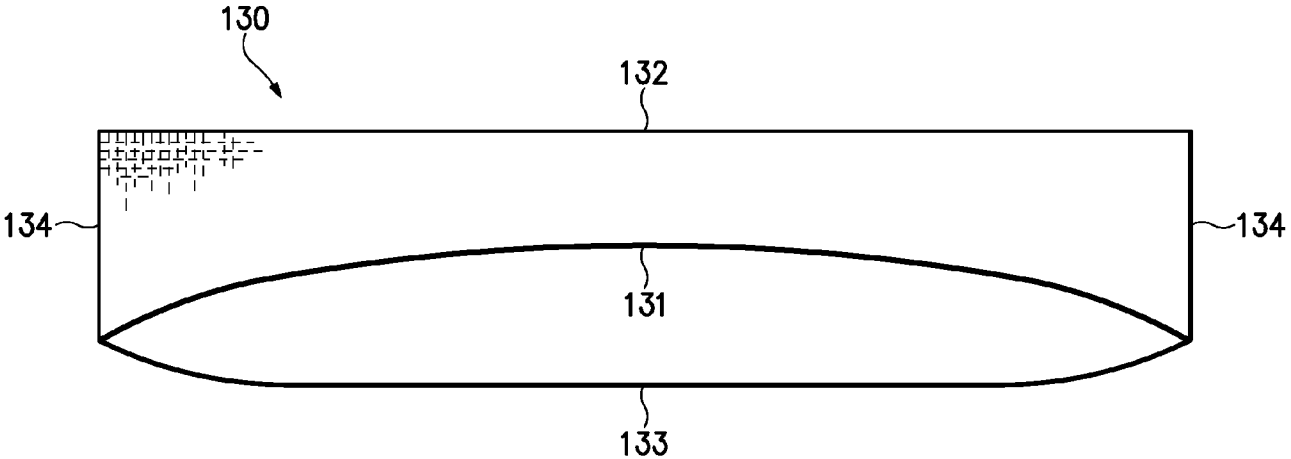
Figure 9N:
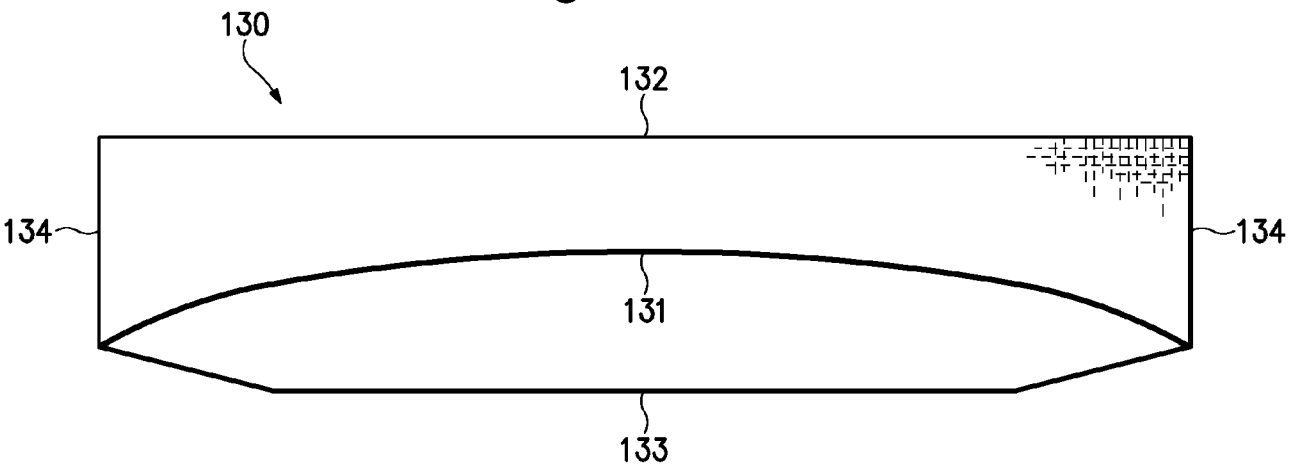

Crease 131 is discussed above as being spaced from edges 132-134, parallel to free edge 132, centrally-located, and generally linear, for example. In further configurations of collar 130, crease 131 may exhibit a variety of other shapes, locations, lengths, etc. As examples, crease 131 may be adjacent to free edge 132 (see FIG. 9A), exhibit significantly longer lengths (see FIG. 9B) or shorter lengths (see FIG. 9C), have a non-continuous structure (see FIG. 9D), be non-linear (see FIG. 9E) and/or nonparallel to free edge 132 (see FIG. 9F). Moreover, collar 130 may also incorporate multiple creases 131 (see FIG. 9G). Various aspects relating to collar 130 may also vary. As examples, collar 130 may have a curved configuration (see FIG. 9H), a structure wherein areas adjacent to side edges 134 have greater width than a central area (see FIG. 9I), or a non-regular aspect (see FIG. 9J). In further configurations, collar 130 may have a variety of shapes and crease 131 may extend between side edges 134 (see FIGS. 9K-9N). Accordingly, various aspects relating to collar 130 and crease 131 may vary significantly from the configuration discussed above.

Although apparel 100 has the configuration of a short-sleeved shirt, particularly, a polo shirt, apparel 100 may also have the configuration of various other shirt-type garments, including long-sleeved shirts, tank tops, undershirts, jackets, or coats. That is, the concepts related to collar 130 and crease 131 may also be incorporated into a variety of other shirt-type garments. Additionally, the concepts may be incorporated into a variety of other types of garments, including hats, footwear, and gloves, for example. Accordingly, the concepts discussed above with respect to apparel 100 may also be applied to any type of garment that incorporates a crease or crease-like structure.

Figure 10:
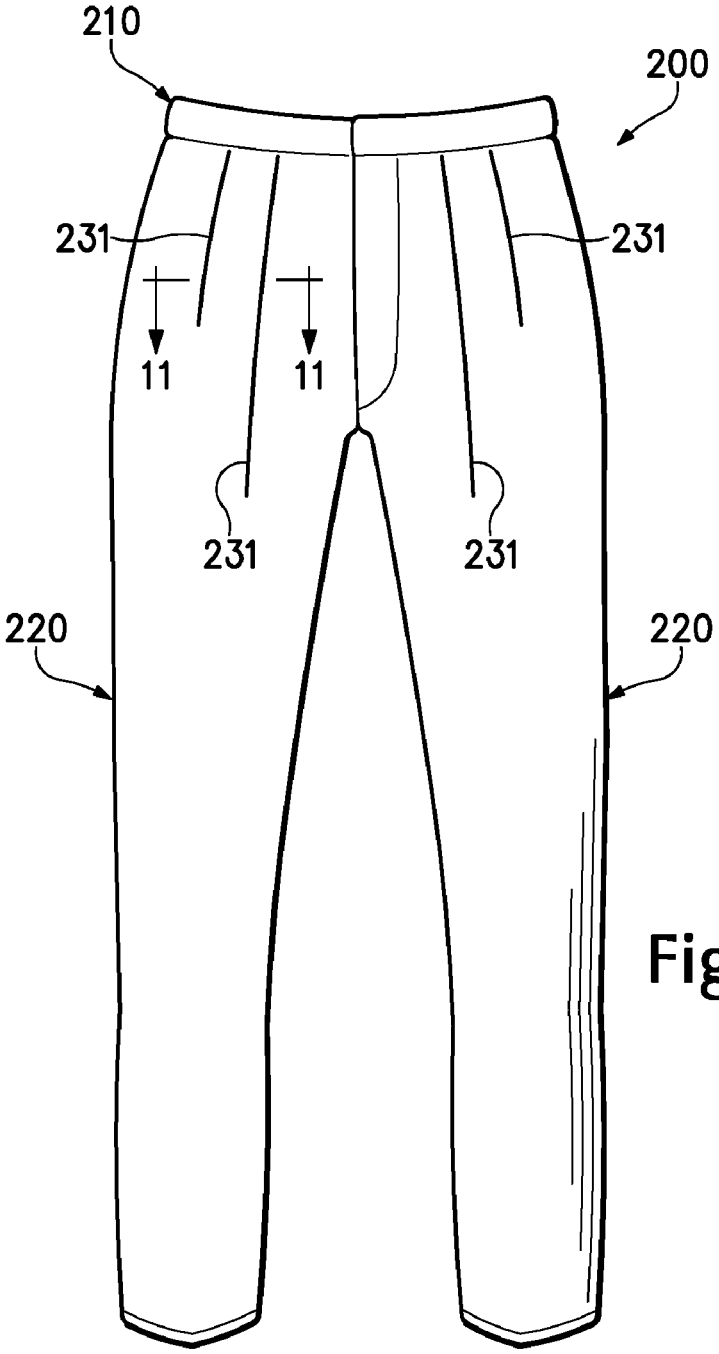
FIG. 10 is a front elevational view of another article of apparel.
Figure 11:
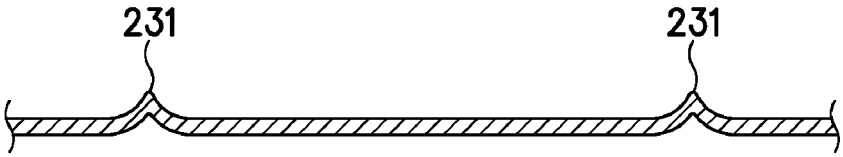
FIG. 11 is a cross-sectional view of a portion of the article of apparel depicted in FIG. 10, as defined by section line 11-11 in FIG. 10.

As a further example of the manner in which the concepts related to creased textile elements may be incorporated into other types of garments, an article of apparel 200 is depicted in FIG. 10 as having the configuration of a pair of pants. Apparel 200 includes a pelvic region 210 and a pair of leg regions 220 that extend outward from pelvic region 210. Each of pelvic region 210 and leg regions 220 are formed from textile elements that define various creases 231. As with crease 131, creases 231 may be knitted into the structure of the textile elements that form apparel 200, potentially with flat knitting. Creases 231 may also form protruding areas on the exterior surface of apparel 200 and indented areas on the interior surface of apparel 200. In general, therefore, creases similar to creases 131 may be incorporated into a variety of apparel types.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of apparel comprising:

a torso region for covering at least a portion of a torso of a wearer, the torso region defining a neck opening and an opposite waist opening;

a pair of arm regions for covering at least a portion of arms of the wearer, the arm regions extending outward from the torso region; and a collar extending from the torso region and positioned adjacent to the neck opening, the collar being formed from a knitted textile element that defines an attachment edge that is joined to the torso region, an opposite free edge, and a pair of side edges extending from the attachment edge to the free edge, and the collar having a crease formed from a raised course located between two other courses, the raised course having a length that is (a) less than lengths of the two other courses and (b) less than one-third of a distance between the side edges.

2. The article of apparel recited in claim 1, wherein the raised course is substantially parallel to the free edge.

3. The article of apparel recited in claim 2, wherein the raised course is substantially perpendicular to the side edges.

4. The article of apparel recited in claim 1, wherein the raised course is centered between the side edges.

5. The article of apparel recited in claim 4, wherein the raised course is located between one-third and two-thirds of a distance from the free edge to the attachment edge.

6. The article of apparel recited in claim 4, wherein the raised course is located between one-half and six-tenths of a distance from the free edge to the attachment edge.

7. The article of apparel recited in claim 1, wherein the textile element has a first surface and an opposite second surface, the first surface defining a protruding area proximal to the raised course, and the second surface defining an indented area proximal to the raised course.

8. An article of apparel comprising:

a torso region for covering at least a portion of a torso of a wearer, the torso region defining a neck opening and an opposite waist opening;

a pair of arm regions for covering at least a portion of arms of the wearer, the arm regions extending outward from the torso region; and a collar extending from the torso region and positioned adjacent to the neck opening, the collar defining an attachment edge that is joined to the torso region, an opposite free edge, and a pair of side edges extending from the attachment edge to the free edge, and the collar having a crease that is:

(a) substantially parallel to the free edge, (b) located between one-half and six-tenths of a distance from the free edge to the attachment edge, (c) centered between the side edges, and (d) formed to have a length that is less than one-third of a distance between the side edges, the crease being formed from a raised course located between two other courses, the crease having a length that is less than lengths of the two other courses.

9. The article of apparel recited in claim 8, wherein the collar is formed from a knitted textile element.

10. The article of apparel recited in claim 8, wherein the length of the crease is substantially equal to the length of the raised course.

11. The article of apparel recited in claim 8, wherein the collar has a first surface and an opposite second surface, the first surface defining a protruding area proximal to the raised course, and the second surface defining an indented area proximal to the raised course.

12. An article of apparel comprising:

a torso region for covering at least a portion of a torso of a wearer, the torso region defining a neck opening and an opposite waist opening;

a pair of arm regions for covering at least a portion of arms of the wearer, the arm regions extending outward from the torso region; and a collar extending from the torso region and positioned adjacent to the neck opening, the collar being formed from a knitted textile element defining an attachment edge that is joined to the torso region, an opposite free edge, and a pair of side edges extending from the attachment edge to the free edge, and the collar having a crease formed from a raised course located between two other courses, the raised course having a length that is less than lengths of the two other courses, the raised course being located between and separating the two other courses, and the two other courses being joined to each other between opposite ends of the raised course and the side edges.

13. The article of apparel recited in claim 12, wherein the raised course is substantially parallel to the free edge.

14. The article of apparel recited in claim 13, wherein the raised course is substantially perpendicular to the side edges.

15. The article of apparel recited in claim 12, wherein the raised course is centered between the side edges.

16. The article of apparel recited in claim 15, wherein the raised course is located between one-half and six-tenths of a distance from the free edge to the attachment edge.

17. The article of apparel recited in claim 12, wherein a length of the raised course is less than one-third of a distance between the side edges.

18. The article of apparel recited in claim 12, wherein the textile element has a first surface and an opposite second surface, the first surface defining a protruding area proximal to the raised course, and the second surface defining an indented area proximal to the raised course.

19. An article of apparel comprising:

a torso region for covering at least a portion of a torso of a wearer, the torso region defining a neck opening and an opposite waist opening;

a pair of arm regions for covering at least a portion of arms of the wearer, the arm regions extending outward from the torso region; and a collar extending from the torso region and positioned adjacent to the neck opening, the collar being formed from a knitted textile element that defines an attachment edge that is joined to the torso region, an opposite free edge, and a pair of side edges extending from the attachment edge to the free edge, and the collar having a crease formed from a raised course located between two other courses, the raised course having a length that is less than lengths of the two other courses, the raised course being spaced inward from the side edges, and the two other courses extending to the side edges.

20. The article of apparel recited in claim 19, wherein the raised course is substantially parallel to the free edge.

21. The article of apparel recited in claim 20, wherein the raised course is substantially perpendicular to the side edges.

22. The article of apparel recited in claim 19, wherein the raised course is centered between the side edges.

23. The article of apparel recited in claim 22, wherein the raised course is located between one-half and six-tenths of a distance from the free edge to the attachment edge.

24. The article of apparel recited in claim 19, wherein a length of the raised course is less than one-third of a distance between the side edges.

25. The article of apparel recited in claim 19, wherein the textile element has a first surface and an opposite second surface, the first surface defining a protruding area proximal to the raised course, and the second surface defining an indented area proximal to the raised course.

26. An article of apparel comprising:

a torso region for covering at least a portion of a torso of a wearer, the torso region defining a neck opening and an opposite waist opening;

a pair of arm regions for covering at least a portion of arms of the wearer, the arm regions extending outward from the torso region; and a collar extending from the torso region and positioned adjacent to the neck opening, the collar defining an attachment edge that is joined to the torso region, an opposite free edge, and a pair of side edges extending from the attachment edge to the free edge, and the collar having a crease that is:

(a) substantially parallel to the free edge, (b) centered between the side edges, and (c) formed to have a length that is less than one-third of a distance between the side edges, the crease being formed from a raised course located between two other courses, the crease having a length that is less than lengths of the two other courses.

27. The article of apparel recited in claim 26, wherein the collar is formed from a knitted textile element.

28. The article of apparel recited in claim 26, wherein the length of the crease is substantially equal to the length of the raised course.

29. The article of apparel recited in claim 26, wherein the collar has a first surface and an opposite second surface, the first surface defining a protruding area proximal to the raised course, and the second surface defining an indented area proximal to the raised course.

* * * * *